United States Patent [19]

Kuhns

[11] 4,270,351

[45] Jun. 2, 1981

[54] HEAT ENGINE AND THERMODYNAMIC CYCLE

[76] Inventor: John P. Kuhns, 1332 Kathryn St., Hurst, Tex. 76053

[21] Appl. No.: 960,233

[22] Filed: Nov. 13, 1978

[51] Int. Cl.[3] ..... F01B 15/06

[52] U.S. Cl. ..... 60/517; 60/508; 60/650; 60/682

[58] Field of Search ..... 60/650, 682, 508, 516, 60/517

[56] References Cited

U.S. PATENT DOCUMENTS

| | | | |
|---|---|---|---|
| 1,032,236 | 7/1912 | Patten | 60/650 |
| 1,926,463 | 9/1933 | Stoddard | 60/650 |
| 3,867,816 | 2/1975 | Barrett | 60/682 |
| 4,077,221 | 3/1978 | Maeda | 60/682 |

*Primary Examiner*—S. Clement Swisher

*Attorney, Agent, or Firm*—Wm. T. Wofford

[57] ABSTRACT

Method of and apparatus primarily for converting source heat to work characterized by a gas phase working fluid thermodynamic prime mover cycle of isentropic temperature rise followed by heat acquisition followed by isentropic temperature drop followed by heat rejection to a heat sink accomplished by a variety of embodiments. Although deemphasized herein, it is further characteristic that these same embodiments going through the same motions in the same directions will to a limited extent pump heat to the heat source at the expenditure of work should the temperature difference of the sink/source become smaller than required for prime mover operation. In this invention, heat is exchanged between the compressed working fluid and the hot body only and the expanded working fluid and the cold body only.

4 Claims, 21 Drawing Figures

HEAT ENGINE AND THERMODYNAMIC CYCLE

BACKGROUND OF THE INVENTION

1. Field of the Invention

This invention relates to a new method and engines for converting caloric energy into work, making practical a thermodynamic cycle heretofore thought ideal, or only theoretical. More particularly, this invention relates to a new method having a plurality of embodiments for doing work in which substantially all or only a portion of the theoretical available energy can be used in accordance with a newly pragmatic thermodynamic cycle, depending upon the operating conditions in which the new method is to be employed.

2. Description of the Prior Art

The prior art has seen the development of a wide variety of methods and heat engines creating a variety of thermodynamic cycles. These have ranged from the internal combustion engines with the Otto cycle and the diesel cycle through the externally fired heat engines, with the Rankine cycle and the Stirling cycle.

One trouble with a prior practical Stirling cycle prime mover is that the heat engine is simultaneously a refrigeration machine covertly draining heat source energy at the expense of the prime mover phenomenon taking place. This happens because the prime mover direction of rotation is the same direction which by notorious heat pump effect would cause the engine hot end temperature to drop below ambient, for illustration, if that machine were purposely overdriven. The net result is more heat being drained from source and rejected to sink than might otherwise be expected.

Another trouble with many "external combustion" engines is the use of regenerators/recouperators. The object is to "recoup" the heat lost in high temperature exhaust gas by using it to heat newly compressed working fluid. The trouble is that this effect cuts off when exhaust temperature drops to compressor outlet temperature. Such devices invariably reject the heat of compression. When one is used there is no possible way to avoid this undesirable effect. It can only be minimized by other deleterious compromise such as lowered compression ratio plus pressurization or increased displacement. But compression ratio cannot be reduced to zero because at zero pressure difference no work can be rendered. At best the regenerator exhaust temperature will be significantly higher than some other more ideal means of obtaining low exhaust temperature. Thus many good sources of heat are not hot enough to energize existing engines. Thus in response to the workings of supply and demand the costs of energy are higher than they might otherwise be.

One of the best theoretical cycles is the Carnot cycle which is the theoretical cycle of an ideal heat engine of maximum thermal efficiency. This has been the ideal toward which others approach but has not been realizable because no practical way has yet been developed to achieve the results of isothermal expansion, isentropic expansion, isothermal compression, and isentropic compression to the initial state.

SUMMARY OF THE INVENTION

Accordingly, it is an object of the present invention to provide method and apparatus that approach the ideal thermal efficiency of the Carnot cycle in specific embodiments and approach portions thereof depending upon other practical operating conditions available.

It is also an object of this invention to provide method and apparatus that are capable of deriving useful work when employed between heat source and sink with temperature differentials less than that necessary for energizing ordinary and prior art methods and apparatus.

These and other objects of this invention will be more clearly understood by reference to the following descriptive matter and appended drawings.

One aspect of the present invention is much improved heat to work conversion efficiency achieved by the novel feature of reversing the polarity of the above mentioned covert heat pump effect so it no longer subtracts from conversion efficiency and output power. This reversal is accomplished by phase shift of heat exchange events wherein heat is rejected to cold body only during minimum pressure phase and heat is received from hot body only during maximum pressure phase.

Another aspect of the present invention results in higher specific output along with further increase of efficiency and relaxed heat source requirements. This is achieved by replacing the regenerator/recouperator function with an isentropic temperature alternating process matched to sink-source temperature difference. Secondary benefits include improved design freedom and simplicity.

Overall results of the present invention creates simple, efficient compact high power engines and other engines producing useful power at temperature difference too small to energize most existing engines.

In accordance with this invention there is provided a method and apparatus for carrying out the method, in which a compressible fluid is subjected to a thermodynamic cycle comprising an isentropic temperature increase, followed by heat acquisition to increase entropy, followed by isentropic temperature decrease, followed by heat rejection to reduce entropy. This invention includes a variety of embodiments employed to convert available heat into work.

DESCRIPTION OF PREFERRED EMBODIMENTS

The present invention can embody a wide variety of different types of apparatus. It is believed helpful to consider the theoretical stages of the cycle in order to understand the practical aspects, both method and apparatus.

Figure 1:
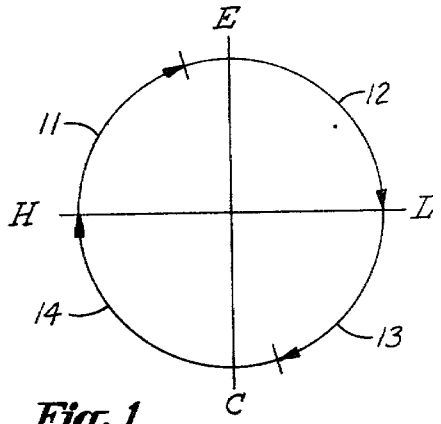
FIG. 1 is a schematic of the thermodynamic cycle working fluid operations sequence of the present invention.

Referring to FIG. 1, one pass around circle H-E-L-C-H represents one complete cycle of operations upon a confined mass of non-combustion, gaseous, or vapor, phase working fluid subjected to periodic expansion and contraction. Line HL separates volumetric contraction "C" from volumetric expansion "E". Line EC separates large volume low pressure "L" phase of cycle from small volume high pressure "H" phase. Circle intercept H represents minimum displacement. Circle intercept E represents midstroke expansion. Circle intercept L represents maximum displacement. Circle intercept C represents midstroke contraction.

The first operation 11 consists of aspirating a hot body during minimum volume high pressure "H" phase of cycle.

The second operation 12 consists of isentropic expansion to reduce working fluid temperature.

The third operation 13 consists of aspirating a cold body during maximum volume low pressure "L" phase of cycle. The term "aspiration" is used herein in the sense of causing fluid flow so as to bring about the indicated heat exchange. It encompasses working fluid flow past a heat exchanger in which the indicated hot or cold fluid is being flowed or working fluid exchange with an indicated hot or cold body fluid reservoir.

The fourth operation 13 consists of isentropic contraction to raise working fluid temperature completing the cycle.

The cold body aspiration 13 is absent during higher pressure states "H" of hot body aspiration 11 and conversely hot body aspiration 11 is absent during lower pressure states "L" of cold body aspiration 13. The significance of this is:

1. The heat of compression is not rejected to cold body before it can be recovered by expansion.
2. The "COLDNESS" of expansion is not degraded by additional source heat before "exhaust" heat can be removed.

Typically, the working fluid mass acquires and rejects heat during the aspirations 11 and 13. Functioning as a heat pump the working fluid rejects heat to the hot body during the high pressure aspiration 11 and acquires heat from the cold body during low pressure aspiration 13.

Utilized as a prime mover the working fluid acquires heat from the hot body during the high pressure aspiration 11 and rejects heat to the cold body during the low pressure aspiration 13.

The only factor determining whether the cycle pumps heat somewhat or generates mechanical work depends on which temperature difference is greater; the working fluid compression ratio temperature difference or the hot/cold body temperature difference. Work generation occurs when the hot/cold body temperature difference is greater and heat pumping occurs when the compression ratio temperature difference is greater.

The FIG. 1 heat exchange operations 11 and 13 can take place within the confines of the entrapped working fluid mass exchanging only heat with respective hot and cold body heat exchangers. Or either or both operations can exchange working fluid transporting heat with respective separate external hot and/or cold body fluid reservoirs.

Each possible variant of the present invention has its own virtues and peculiar limitations. P. V. diagrams of each are superimposed on graphs in FIGS. *2a-d* within the boundaries of a Carnot cycle envelope ABCD coincident with isotherms T and $T_o$ and isentropics $S_0$ and $S_1$.

Present invention P. V. diagrams are within the Carnot cycle boundary because that is the boundary of all possible fluid states within given temperature and entropy limits for a given fluid mass parcel. Other Carnot cycles could be plotted to coincide with other entropy limits $S_{11}$, $S_{12}$, and the like. No thermodynamic cycle can render energy more efficiently than a Carnot cycle. Thus Carnot cycle loops could be fitted to circumscribe any heat engine cycle of equal temperature and entropy limits and given working fluid mass parcel.

Still referring to FIGS. *2a-d*, the area inside the Carnot cycle loop ABCD represents one hundred percent conversion of available heat into work output. The area inside any other Figs. 2-type loop represents the percentage of Carnot work which can be rendered by the particular fluid state operations there inscribed for the stated temperature and entropy limits utilized.

Constant entropy curves $S_0$ and $S_1$ record isentropic temperature changing operations of the present invention. Referring to FIG. *2a*, dotted curves 21 and 23 record heat exchange operations of the closed loop cycle variant of the present invention. This variant produces the highest conversion efficiency to be obtained by the present invention.

Referring to FIG. *2b*, a second variant of the present invention is open loop fluid exchange with an external cold body fluid reservoir at reservoir pressure $P_c$. The dotted curves 21 and 25 define the upper temperature and lower pressure limits in this variant; and all work below isobar $P_c$ is lost, because the cycle is vented to cold body reservoir at pressure $P_c$ during this heat transfer operation. The fluid leaves working loop at $S_1$ intersect isotherm $T_{ve}$ temperature which corroborates the loss of work potential.

Referring to FIG. *2c*, a third variant of the present invention is the inverse of the second where now working fluid is exchanged with external hot body fluid reservoir at reservoir pressure $P_H$. The dotted curves 27 and 23 define the upper pressure and lower temperature limits in this variant; and all work potential above isobar $P_H$ is lost, because the cycle is vented to the hot body reservoir at pressure $P_H$ during this heat transfer operation. This work loss is corroborated by the fact that fluid leaves the working loop at $S_0$ intersect isobar $P_H$ coincident with isotherm $T_{vc}$ whose temperature is well below hot body temperature isotherm T.

Referring to FIG. *2d*, the fourth and last possible heat exchange variant of the present invention has both hot and cold heat exchanges accomplished by respective open loop fluid exchanges with respective external hot and cold body fluid reservoirs at respective reservoir pressures $P_H$ (hot reservoir) and $P_c$ (cold reservoir). This variant is the least efficient of the four. The dotted curves 27 and 25 define the upper and lower pressure limits; and potential work both above isobar $P_H$ and below isobar $P_c$ is lost, because of the vented condition during both acquisition and rejection of heat as previously explained.

The respective apparatuses and methods effecting the theoretical cycles of FIGS. *2a-d* will now be described.

Referring now to FIGS. *3a-d*, there is illustrated a closed loop prime mover apparatus embodiment of the present invention for carrying out an embodiment in accordance with FIG. *2a*. Referring to FIG. *3a*, maximum entropy working fluid 31 and minimum entropy working fluid 32 are confined by vessel comprised of stationary plunger 33 and moving cylinder 34 and moving piston 35; all linked together by piston connecting rod 36 and cylinder connecting rod 37 and stationary plunger connecting rod (crankshaft) 38. Countermotion connecting rods 46, 47 and (crankshaft) 48 counterbalance transverse thrusts and inertias reducing friction and vibration. Inside the vessel is stationary cold body heat exchanger 39 and stationary hot body heat exchanger 40 both attached to stationary plunger 33. Cold and hot fluids are circulated through the respective exchangers through appropriate copper tubing lines or the like, shown as lines 50, 52.

The ordinary engineering technology that is employed in the conventional engines will be employed herein to effect seals between the respective moving parts and to minimize friction between one or more elements having relative rotation or motion therebetween. Specifically, the seals on the moving piston 35 and the stationary plunger 33 may by any of the conventional seals employed with the respective working fluid and the temperatures involved in compressing the compressible working fluid. As will be understood from the descriptive matter hereinafter, the working fluid in this invention is a compressible working fluid such as a gas. Ordinarily, it is advantageous if there is no change of phase of the working fluid in embodiments of this invention, as described herein. The seals between the piston 35 and the surrounding cylinder 34 may employ the usual piston rings. One of the advantages of this invention is that the pressures do not reach the extremes experienced in the prior art machines so relatively little difficulty is encountered in sealing the fluids contained herein. The working fluid, per se, may comprise air or other fluids from a heat source or a heat sink, or even steam or the like if the temperature maintained is above the condensation temperature of the steam. In fact, almost any vapor phase fluid from whatever source may be employed as long as it is compressible for use in the respective embodiments.

The respective interconnections between the connecting rods and the interconnecting rod ends or pin shafts, may be those ordinarily employed, such as bushings or the like with suitable self-lubricating bushings or lubrication inserts with lubrication distribution lines (not shown). The crankshaft 38 may simply be a crank having an output shaft that will be connected to a power delivery means, such as a transmission, gear or belt drive or the like. The power may be either supplied when the apparatus is employed in pumping heat or may be delivered from the apparatus to a using source such as a generator, pump or the like, when employed as a prime mover. It is noteworthy that the crankshaft 38 and the countermotion crankshaft 48 rotate oppositely about respective fulcrum shafts 49, 51 that are journalled to accommodate the rotation. Specifically, either or both of the respective shafts 49, 51 may have power delivery shafts for delivering power one way or the other. Any of the conventional arrangements for syncronized counter rotation may be employed for the crankshafts 38 and 48. It will be apparent that the connecting rods and shafts are connected so as to rotate in concert when power must be delivered. The other respective rod ends and shafts at the juncture of the respective connecting rods accommodate relative rotational motion between the respective rods and the elements to which they are fastened, similar to the conventional connecting rod between the piston and crankshaft in an internal combustion engine.

Figure 3A:
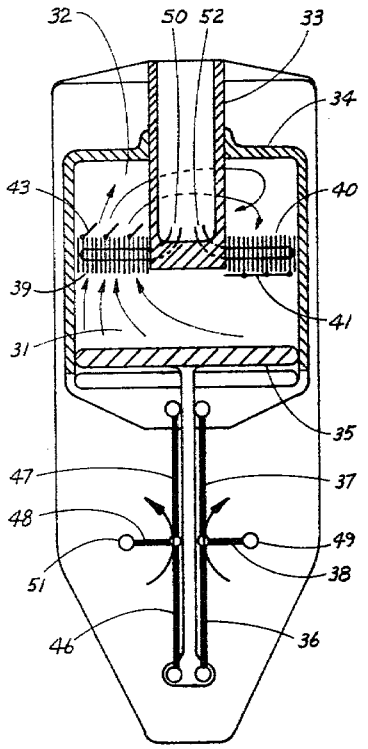
FIGS. 3*a–d* are schematic illustrations of different stages of operation of a closed working fluid loop heat exchanging embodiment of the present invention.

In FIG. 3*a*, the moment of maximum displacement has passed. Cylinder 34 and piston 35 are moving upward, intruding on stationary plunger 33, reducing vessel displacement and forcing contained working fluid through cold body heat exchanger 39 and flapper check valve 43. Flapper check valve 41 prevents upward flow through hot body exchanger 40. As a consequence, working fluid rejects heat to exchanger 39 and enters compression space 42 at minimum entropy.

Figure 3B:
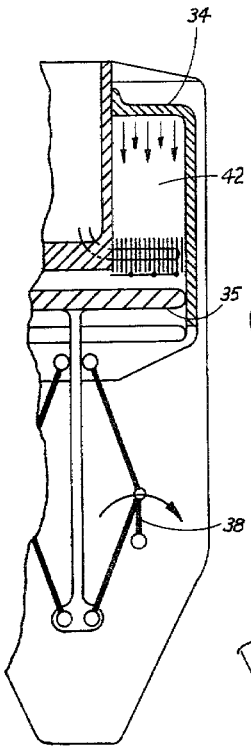

Referring now to FIG. 3*b* , moving cylinder 34 is starting down having passed its top dead center (TDC) position and piston 35 is just approaching its TDC position. Essentially, all of the working fluid is now in compression space 42 and fluid temperature is rising isentropically, because of contraction of compression space 42 due to downward motion of cylinder 34.

Figure 3C:
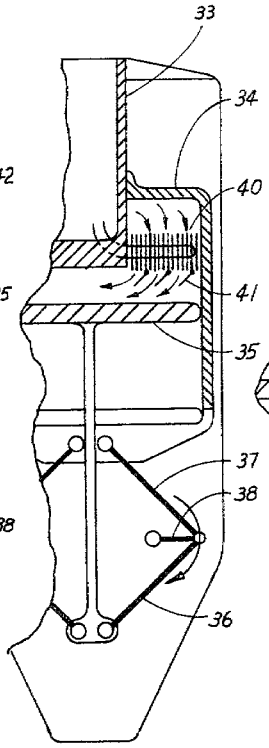

Referring to FIG. 3*c*, the moment of minimum displacement has just passed and cylinder 34 is decelerating to bottom dead center (BDC) and piston 35 is accelerating after TDC and displacement is increasing because of downward motion retreat from stationary plunger 33 of both piston and cylinder 35 and 34. During this period of expansion, working fluid takes on heat to maximum entropy in passage through the hot body heat exchanger 40 due to downward motions of piston 35 and cylinder 34. Flapper check valve 43, FIG. 3*a*, prevents fluid flow downwardly through cold body heat exchanger 39.

Figure 3D:
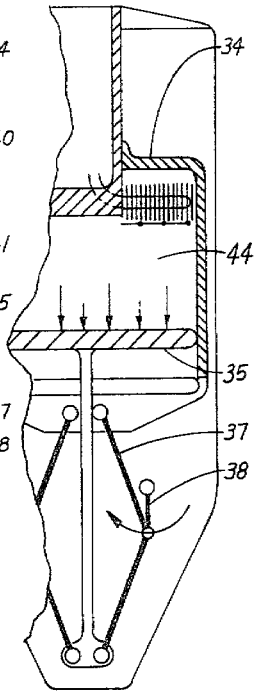

Referring now to FIG. 3*d*, cylinder 34 has remained near its BDC position due to connecting rod 37 and crankshaft 38 geometric interactions. Meanwhile, piston 35 is approaching its BDC position and has expanded vessel displacement and thereby caused considerable isentropic cooling of the working fluid; essentially, all of which has taken place in expansion space 44.

FIG. 3*d* illustrates the moment of transition between isentropic expansive cooling operation ending and cold body heat exchange compressive operation beginning. The next moment, or stage in the illustrated cycle would be a repetition of FIG. 3*a*.

The apparatus of FIGS. 3*a*–*d* is operated as an engine to develop power on the crankshaft 38 when the compression temperature $T_2$ is less than the temperature of the hot heat transfer fluid being circulated through the hot body exchanger 40. In this mode, the transfer fluid circulated through the hot body exchanger 40 gives up heat during the stage shown in FIG. 3*c*. The heat given up by the hot fluid to the compressed working fluid causes an expansion that moves the piston downwardly to impart power to the crankshaft 38, FIGS. 3*c* through 3*d*. The waste heat in excess of the heat converted to mechanical power is then removed from the gas by the cold heat transfer fluid being circulated through the cold body exchanger 39 during this stage of the cycle illustrated by FIG. 3*a*. The shaded area of FIG. 2*a* indicates the work generated by the FIG. 3 engine.

Figure 2A:
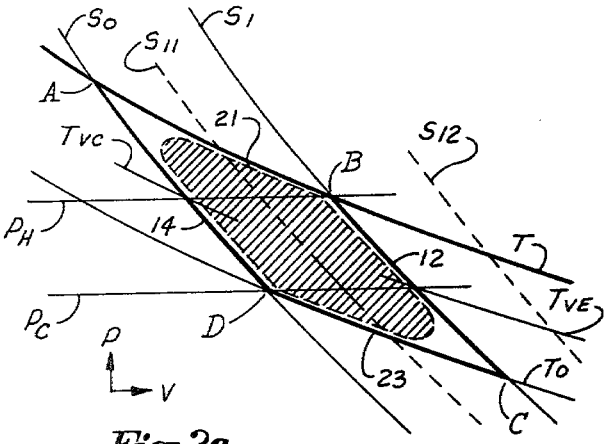
FIGS. 2*a–d* are graphs depicting various pressure-volume (P. V.) diagrams of the present invention superimposed on a Carnot cycle P. V. diagram.
Figure 2B:
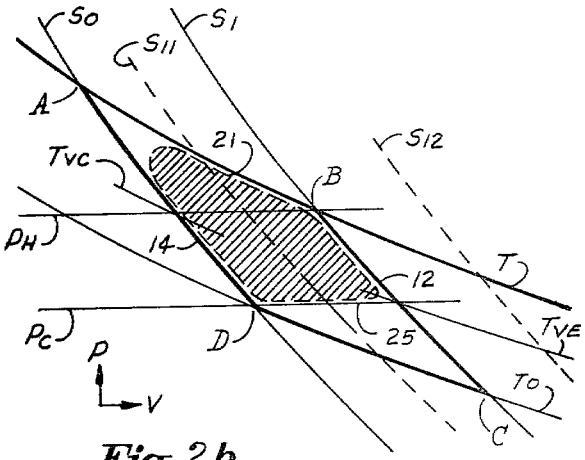

FIG. 4 illustrates an open loop prime mover apparatus embodiment of the present invention exchanging heat transporting fluid with an external cold body fluid reservoir for carrying out an embodiment in accordance with FIG. 2*b*. This embodiment is the same as the closed loop apparatus just described in FIG. 3, with the apparatus elements being the same except the cold body heat exchanger 39 of FIG. 3 is not present, being replaced by an external cold body fluid reservoir 59 of FIG. 4. A cold body reservoir fluid inlet back flow preventer valve, or check valve, 53, FIG. 4, replaces cold body exchanger backflow preventer valve 43 of FIG. 3.

The FIG. 4 apparatus has a working fluid exhaust valve, illustrated as cylinder ports 55 located to remain closed except during working fluid exchange operation with cold body fluid reservoir 59. It is shown as open during the exchange illustrated in FIG. 4*a*. Cold fluid enters inlet valve 53. Ports 55 will remain open during fluid exchange stroke wherein flapper check valve 41 prevents upward back flow through hot body exchanger 40. Thereafter piston 35 will close off port 55 which will remain shut during the rest of the operations until piston 35 and cylinder 34 next assume their maximum displacement phase at the beginning of the next fluid exchange stroke.

Figure 4A:
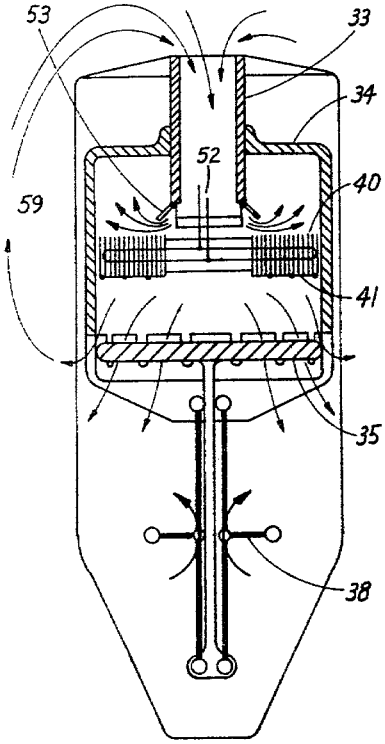
FIGS. 4*a–d* are schematic illustrations of different stages of operation of external cold body, or heat sink, fluid exchanging embodiment of the present invention.
Figure 4B:
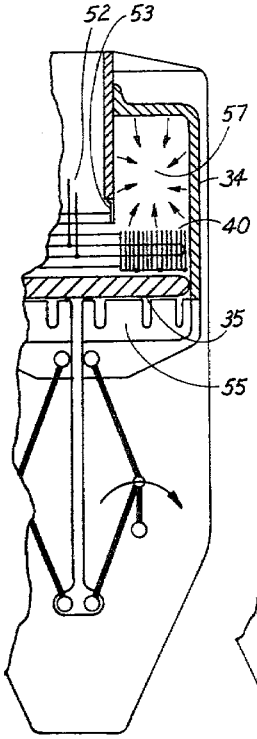

Referring now to FIG. 4*b*, there is illustrated an isentropic temperature rise operation on working fluid in compression space 57 by relative motions of cylinder 34 and piston 35. Specifically, the piston 35 is starting to pause at its TDC and cylinder 34 has started down, closing exhaust ports 55. The enclosed volume is decreased by the downwardly moving cylinder 34. This operation is substantially the same as previously described for the FIG. 3*b* closed loop apparatus.

Figure 4C:
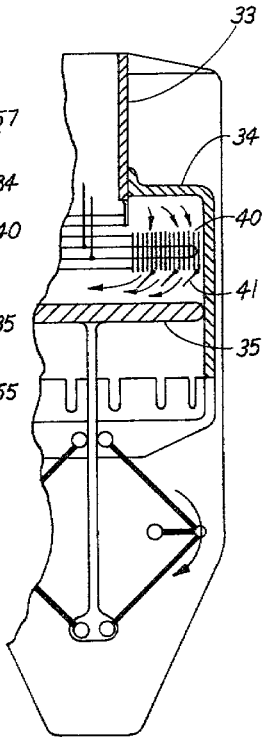

FIG. 4*c* shows a hot body heat exchange occurring during initial phase of vessel expansion. This operation likewise is substantially the same as its counterpart illustrated in FIG. 3*c* for the closed loop apparatus. The moment of minimum displacement has just passed and cylinder 34 is decelerating to BDC. Piston 35 is accelerating after TDC and displacement is increasing because of downward retreat from plunger 33 of both piston 35 and cylinder 34. Fluid is passing through hot body exchanger 40. The space vacated by the cold body heat exchanger 39 of FIG. 3 is occupied by additional hot body heat exchanger 40 with beneficial heat transfer results. Line 52 supplies hot fluid to exchanger 40.

Figure 4D:
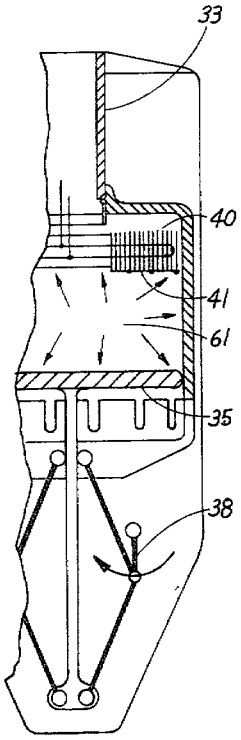

Referring now to FIG. 4*d*, the working fluid is subject to isentropic cooling expansion in expansion space 61. This also is substantially the same as its counterpart illustrated in FIG. 3*d* for closed loop apparatus except at the end of expansion, FIG. 4*d*, cylinder ports 55 vent the expansion space to the external cold body fluid reservoir. The ensuing aspiration, FIG. 4*a*, exchanges fluid with the reservoir 59 at constant reservoir pressure in contrast to the FIG. 3*a* closed loop apparatus which exchanges heat only at varying pressure.

To develop power with the embodiment of FIGS. 4*a–d*, the temperature of the hot body must be greater than the temperature to which the fluid is compressed in the space 57. Expressed otherwise, the fluid is discharged during the operation of FIG. 4*a* and fresh cold body fluid is brought in through the inlet valve 53. Thereafter, the relative upward motion of the piston sealing the exhaust ports and the cylinder about the plunger 33 compress the working fluid, or gas, isentropically in the space 57. Following the minimum volume effected by downward movement of the cylinder 34 with respect to the piston 35, the working fluid is flowed past the hot body heat exchanger 40 and given heat from the heat transfer fluid being circulated through tubes 52 therewithin. The working fluid, consequently, expands, moving the piston 35 downwardly and doing work on the crankshaft 38, FIG. 4*d*. As the piston opens the exhaust ports 55, the exhaust gases are relieved; the cylinder and piston begin to move upwardly closing the flapper valve 41. Consequently, the working fluid, such as air, is sucked inwardly through the inlet valve 53, as described with respect to FIG. 4*a*. The cycle is repeated. The shaded area of FIG. 2*b* indicates the work generated by the FIG. 4 engine.

Figure 2C:
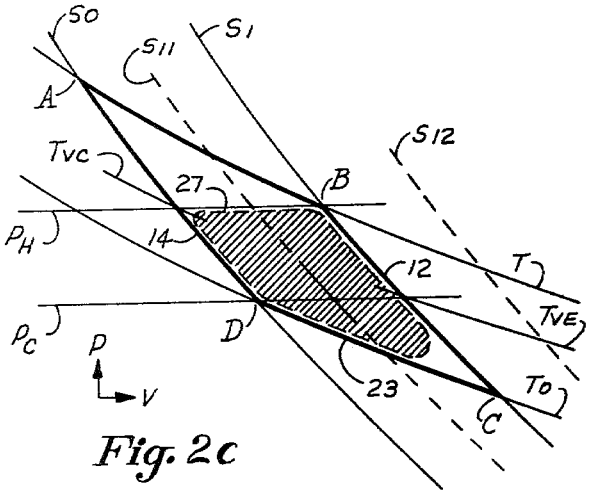

FIGS. 5*a–d* illustrate an open loop prime mover apparatus embodiment of the present invention exchanging heat transporting fluid with an external hot body fluid reservoir for carrying out an embodiment in accordance with FIG. 2*c*. Like numbered elements are the same as described hereinbefore with respect to FIGS. 3*a–d* and 4*a–d*. The FIG. 5 hot body open loop apparatus in most ways is similar to the previously described FIG. 3 closed loop apparatus. However, the FIG. 5 operations are an inversion of FIG. 4 operations wherein FIG. 5 cylinder port 65 is located at the other extreme of piston 34 displacement so that interior working fluid is vented with external hot body fluid reservoir at constant maximum working fluid pressure phase. Whereas the FIG. 4 device incorporates an internal hot body heat exchanger 40, the FIG. 5 device incorporates an internal cold body heat exchanger 39. Where the FIG. 4 apparatus has a cold reservoir fluid inlet check valve 53, which also prevents backflow to reservoir during high working pressure phase; the FIG. 5 apparatus has a compressed working fluid outlet check valve 67, which prevents hot high pressure reservoir fluid backflow during reduced working pressure phase. Where the FIG. 4 engine generates work from the difference between isentropic compression and isothermal expansion, a FIG. 5 engine generates work from the difference between isentropic expansion and isoethermal compression.

Whereas a FIG. 4 engine has a brake mean effective pressure (BMEP) above ambient pressure cold sink reservoir, a FIG. 5 engine has a BMEP below ambient pressure heat source reservoir.

Figure 5A:
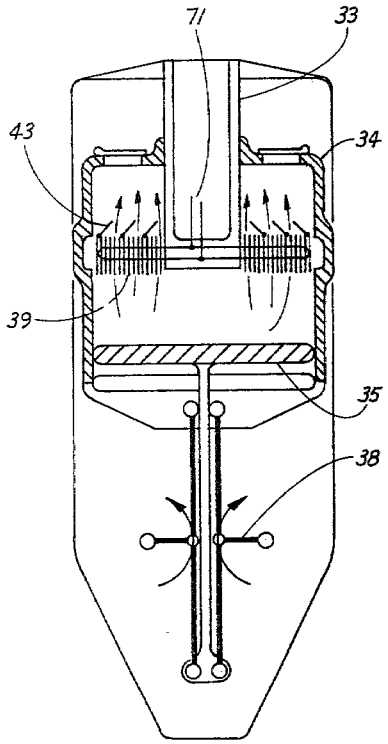
FIGS. 5*a–d* are schematic illustrations of different stages of operation of an external hot body, or heat source, fluid exchanging embodiment of the present invention.
Figure 5B:
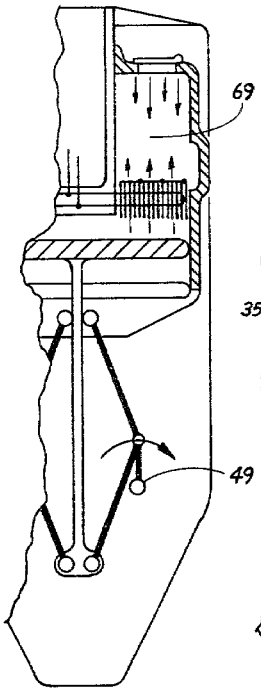

Specifically, the moment of maximum displacement is just past in FIG. 5*a*. Cylinder 34 and piston 35 are moving upwardly intruding on stationary plunger 33 and reducing vessel displacement. As a consequence of this action, there is compressing of the contained fluid which is rejecting heat to the cold body exchanger 39 through which it is passing due to upward motion of piston 35 and cylinder 34 and the opening of flapper check valve 43. In FIG. 5*b*, moving cylinder 34 is starting down, having past its TDC position and piston 35 is just approaching its TDC position. Essentially all of the working fluid is in compression space 69 and fluid temperature is rising isentropically due to contraction of the compression space 69 because of the downward motion of the cylinder 34.

Figure 5C:
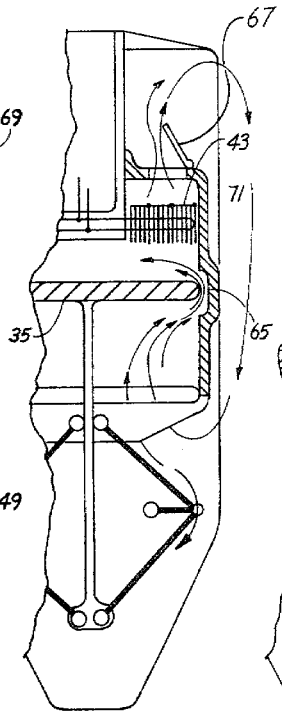
Figure 5D:
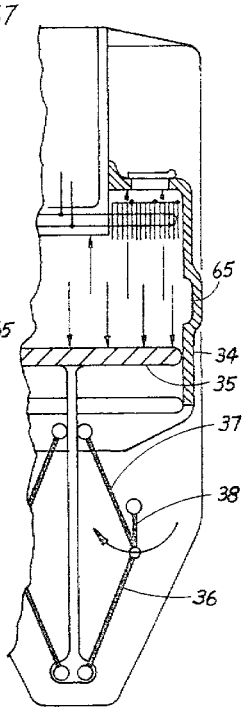

In FIG. 5*c*, the moment of minimum displacement opening engine inlet valve 65 is just past and the cylinder 34 is decelerating to BDC and piston 35 is accelerating after TDC. The flapper check valve 43 is closed so the fluid outlet check valve 67 opens to allow discharge of the compressed working fluid into the hot reservoir 71. The downward motion of the piston 35 aspirates the hot high pressure reservoir fluid from the hot reservoir 71 into the space on top of the piston 35 through the open valve ports 65. Further downward movement of the piston 35 causes the closure of the ports 65. Thereafter, in FIG. 5*d*, further downward movement of the piston causes isentropic expansion temperature drop to rejection temperature. The next event illustrated would be waste heat rejection as already described in FIG. 5*a*.

With the apparatus of FIGS. 5a–d to develop power, the temperature of the hot fluids in the hot reservoir 71 must be greater than the temperature of the compressed gases discharged through outlet valve 67. The shaded area of FIG. 2c indicates the work generated by the FIG. 5 engine.

Figure 2D:
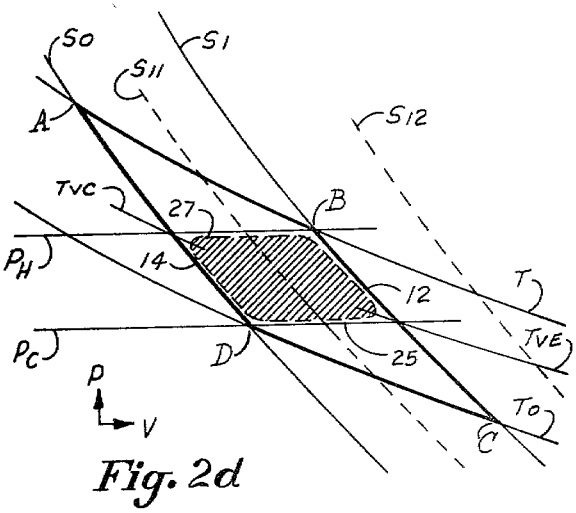

Referring now to FIG. 6, there is illustrated a prime mover embodiment of the present invention which features the absence of heat exchangers for carrying out an embodiment in accordance with FIG. 2d. Energizing heat acquisition and exhaust heat rejection are both accomplished by working fluid exchange with respective external hot and cold body fluid reservoirs 73 and 75 at respective high and low pressures. The FIG. 6 embodiment illustrated is characterized by a ported varying displacement working fluid container consisting of moving piston 77 and moving plunger 79 and stationary cylinder 81 linked together by plunger connecting rod 83, piston connecting rod 85 and stationary cylinder connecting rod (crankshaft) 89. Countermotion connecting rods 86, 87 and 88, counterbalance transverse thrusts and inertias, reducing friction and vibration. The apparatus contains an engine exhaust valve means such as cylinder port 91 and an engine inlet valve means such as cylinder port 93, FIG. 6c. Each valve means 91 and 93 is caused to be open at appropriate times; for example, FIG. 6a (aspirating fluid from cold body reservoir 75 at minimum pressure phase) and FIG. 6c (aspirating fluid from hot body reservoir 73 at maximum pressure phase); and be closed at all other times by some synchronized operator means such as extended skirt 95 and communicating passageways 97 of piston 77. A fluid exchange pumping means such as double acting piston 99 on plunger rod 101, FIG. 6a, expels working fluid and draws in reservoir fluid at appropriate times such that fluid from cold reservoir 75 is aspirated by piston 99 during BDC dwell of piston 77 at maximum displacement while cylinder port 91 is open, FIG. 6a; and, alternately, fluid from hot reservoir 73 is aspirated by piston 99 during TDC dwell of piston 77 at minimum displacement while engine inlet valve 93 is open (FIG. 6c). Flow director check valve 103 prevents higher pressure hot reservoir fluid backflow into working fluid space and similar valve 105 prevents higher pressure working fluid backflow into cold reservoir space. In FIG. 6 type prime mover of the present invention wherein fluid is exchanged with both hot and cold body reservoirs, the fluid leaving the engine to enter the cold reservoir will be less dense than the fluid drawn in from the cold reservoir. Conversely, the fluid leaving the engine to enter the hot reservoir will be more dense than the fluid entering from the hot reservoir. In other words, due to the difference between expander exhaust and compressor inlet temperature on the cold side and a difference between compressor outlet and expander inlet temperature on the hot side; fluid mass from the cold side reservoir will accumulate in the hot side reservoir unless compensated for. If one wants to use this apparatus as a heat energized air compressor, the above situation will be just right. Otherwise, if one wants to generate mechanical shaft power, this migration of fluid mass to the hot side reservoir should be neutrailzed. One means of doing this is the compensating displacement provided by plunger 79, wherein the volume of engine fluid being exhausted to cold reservoir, FIG. 6a, by piston 99 is more than the volume of fluid being drawn in from cold side reservoir by piston 99, minus the volume of plunger 79. Conversely, FIG. 6c, the volume of engine fluid being expelled to hot side reservoir, FIG. 6c, by piston 99 minus plunger 79 is less than the volume of hot side fluid being drawn into the engine by piston 99. With this relationship there is less fluid volume to be compressed than there is to be expanded. This difference between expansion and compression work shows up as available engine work.

Referring to FIG. 2d, the shaded area inside the boundary isentropics $S_0$, $S_1$ and isobars $P_H$ and $P_c$ equals the work rendered by a FIG. 6 type engine of the present invention. Carnot cycle work potential above isobar $P_H$ and below isobar $P_c$ is lost because fluid heating and cooling in the constant pressure hot and cold body fluid reservoirs is isobaric.

Referring to FIGS. 6a–d, plunger 79 relative size is a design variable affecting thermodynamic efficiency and specific output in a reciprocal manner. Expressed specifically, a smaller plunger 79 will bring isentropics $S_0$ and $S_1$, FIG. 2d, closer together, making isobaric entropy change losses a smaller percentage of the PV diagram. On the other hand, a larger plunger will increase isentropic $S_0$ and $S_1$ separation thereby making isobaric entropy change losses a major defect. An optimum plunger size will balance heat rejection against engine output to the user's satisfaction.

Figure 6A:
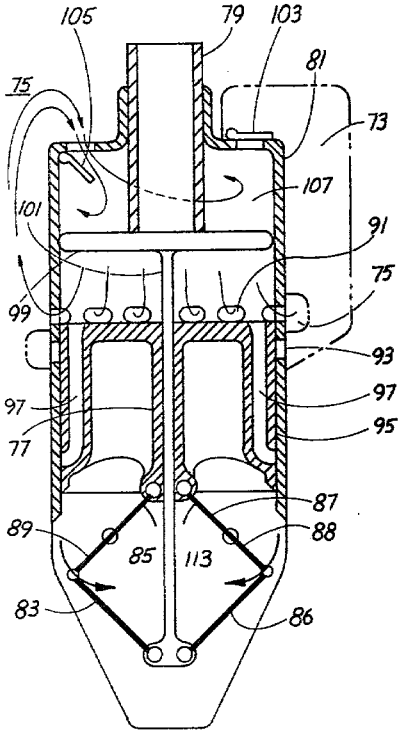
FIGS. 6*a–d* are schematic illustrations of different stages of operation of a heat source/heat sink fluids exchanging embodiment of the present invention.
Figure 6B:
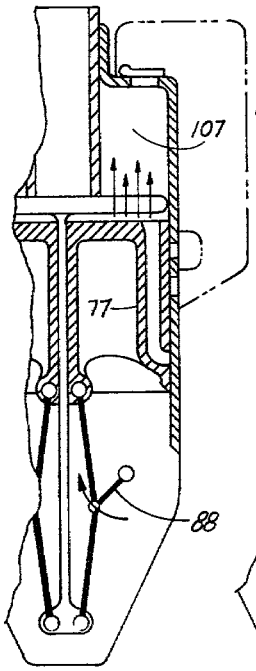

In operation of the embodiment of FIGS. 6a–d, the isentropically expanded fluid is discharged by way of ports 91 by the downward movement of the piston 99 after the ports have been opened by the movement therepast of the lower piston 77. Simultaneously, cold fluid from the low pressure, cold body reservoir 75, is sucked, or aspirated, into the space 107 above the piston 99 through the check valve 105. Referring to FIG. 6b, the lower piston 77 will have moved upwardly closing off the ports and closing the inlet check valve 105. There is isentropic compression in the space 107.

Figure 6C:
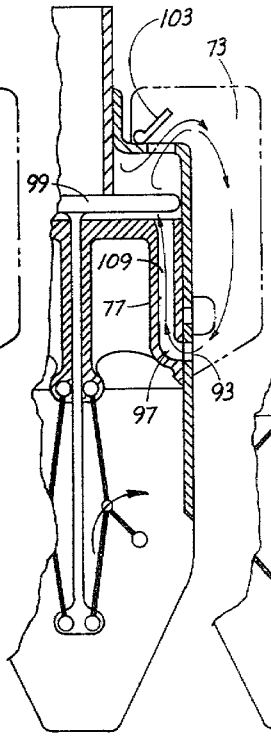
Figure 6D:
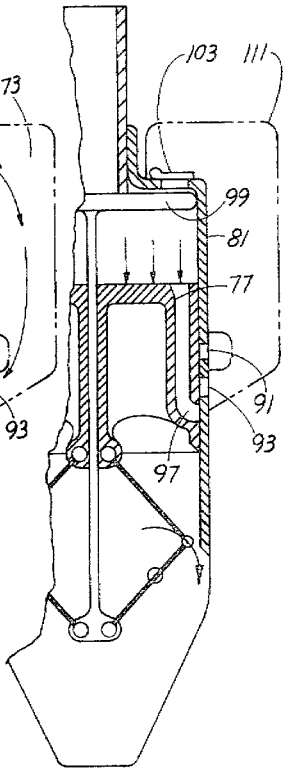

Referring to FIG. 6c, the compression has reached the point that fluid directing check valve 103 is opened, venting the compressed fluid to the hot, high pressure reservoir 73. Simultaneously, upward movement of the lower piston 77 moves its passageway 97 into communication with the port 93, allowing aspirating of the hot fluid from the hot reservoir 73 into the space 109 above the lower piston 77 and below the piston 99. Further porgression to the stage of FIG. 6d, allows the flow directing check valve 103 to close, the port 93 to close by downward movement of the piston 77 and its passageway 97 out of registry therewith; and effect isentropic expansion of the working fluid intermediate the pistons 77 and 99, interiorly of the cylinder 81. As shown in FIGS. 6a–d, the hot reservoir 73 is shown confined by a manifold 111, FIG. 6d. Of course, the manifold may be employed for the cold body reservoir 73 if warranted by the circumstances of operation.

As indicated hereinbefore, the FIG. 6 prime mover apparatus can be employed to furnish a compressed fluid such as compressed air in lieu of mechanical shaft power out. Otherwise adapted, the apparatus of FIGS. 6a–d is capable of delivering power via crankshafts 88 and 89.

It has been shown that the present invention is characterized by a vapor phase working fluid thermodynamic prime mover cycle of isentropic temperature rise followed by heat acquisition followed by isentropic temperature drop followed by heat rejection accomplished by a variety of embodiments. It is further characteristic of this invention that these same embodiments going through the same motions in the same directions can, to a limited extent, pump heat into the prime mover heat source from the prime mover heat sink at the expenditure of work should the temperature difference of the sink/source be less than required for prime mover operation.

From the foregoing, it can be seen that the crankshaft, with appropriate flywheel and piston and cylinder comprise a dynamic energy exchange sustained regenerative cyclic alternating volumetric displacement fluid containment means and output means for the apparatus of this invention.

Although preferred embodiments have been described for carrying out the methods of the present invention other combinations will also provide the correct working fluid environment for cycle operation by those skilled in the art without departing from the scope of the present invention, reference for the latter purpose being had to the appended claims.

What is claimed is:

1. A thermodynamic energy conversion apparatus comprising:

a. a variable volume, pressure tight vessel consisting essentially of a single cylinder and slidable, mating piston therewithin;

b. a plunger slidably and sealingly penetrating through a wall of said vessel to the outside;

c. at least a first heat exchanger mounted within said vessel on said plunger;

d. conduits through said plunger and sealingly connected with said first heat exchanger for heat transport between said heat exchanger and its respective external caloric reservoir serving as a first source for heat exchange;

e. check valve means to allow uni-directional flow of a working fluid past said heat exchanger responsive to relative movement between said plunger, cylinder and piston to transfer heat between said working fluid and said first heat exchanger at a first time in a cycle;

f. a second means for exchanging heat with a second source at an opposite time in said cycle from said heat exchange with said first heat exchanger and for preventing said working fluid from exchanging heat with both said sources at the same time;

g. coordinated interconnecting means for effecting relative motion between said plunger, cylinder and piston such that said cylinder cyclicly alternates between maximum and minimum volumes and displaces said working fluid in one direction for heat exchange with one of said sources at minimum vessel volume and in the opposite direction for heat exchange with the other of said sources at maximum vessel volume; such that said thermodynamic energy conversion apparatus will run as a heat engine when the temperature differences between said sources is sufficiently greater than the compression ratio adiabatic temperature difference and said apparatus can be driven as a heat pump to create a temperature difference equal to or less than the compression ratio adiabatic temperature difference; said compression ratio adiabatic temperature difference being a function dependent on said vessel alternating volume cycle.

2. The thermodynamic energy conversion apparatus of claim 1 wherein said fluid is trapped within said vessel and there are two heat exchangers within said vessel; a first heat exchanger being connected with a cold body source and a second heat exchanger being connected with a hot body source; and said second means includes second check valve means for allowing opposite and unidirectional flow of said working fluid past said second heat exchanger when said first check valve means prevents flow of said working fluid past said first heat exchanger and vice versa.

3. The thermodynamic energy conversion apparatus of claim 1 wherein said means includes cylinder ports penetrating through said vessel walls and being periodically opened during the interval devoted to heat exchange with said second source, said working fluid being exchanged during said open port period for exchange of working fluid for the desired caloric reservoir fluid with the opposite displacement force from that which causes working fluid heat exchange flow past said first heat exchanger at said first time in said cycle.

4. A thermodynamic energy conversion apparatus comprising:

a. a variable volume, pressure tight vessel consisting essentially of a single cylinder and slidable mating piston therewithin; said vessel sealingly enclosing a parcel of vapor phase working fluid;

b. a plunger slidably and sealingly penetrating through a wall of said vessel to the outside;

c. a hot body extended surface heat exchanger and a cold body extended surface heat exchanger mounted within said vessel on said plunger;

d. a plurality of respective conduits penetrating through said plunger for heat transfer between each said heat exchanger and its respective external caloric reservoir; said pairs of conduits being respectively connected with respective said heat exchangers;

e. respective check valve means and configuration of said heat exchangers to partition one end of said vessel from the other end of said vessel such that relative motion between said cylinder, piston and plunger force working fluid to wash first past one of said extended surface heat exchangers to transfer heat between said working fluid and said heat exchanger and to prevent working fluid from exchanging heat with both said heat exchangers at the same time and subsequently past the other of said heat exchangers; such that displacement in one direction prevents flow through one of said heat exchangers and allows flow through the other said heat exchanger and displacement in the opposite direction prevents flow through the other of said heat exchangers and allows flow through the first of said heat exchangers;

f. coordinated interconnecting means for effecting relative motion between said plunger, cylinder and piston such that said vessel cyclicly alternates between maximum and minimum volumes and displaces said entrapped working fluid in one direction for heat exchange with a first of said heat exchangers with minimum vessel volume and in the opposite direction for heat exchange with the other of said heat exchangers at maximum vessel volume;

such that said thermodynamic energy conversion apparatus will run as a heat engine when the temperature difference between said hot body heat exchanger and said cold body heat exchanger is sufficiently greater than the compression ratio adiabatic temperature difference and said apparatus can be driven as a heat pump to create a temperature difference equal to or less than the compression ratio adiabatic temperature difference; said compression ratio adiabatic temperature difference being a function dependent on said vessel alternating volume cycle.

* * * * *